United States Patent [19]

Richardson

[11] 4,259,378

[45] Mar. 31, 1981

[54] WOOD TREATMENT PROCESS

[75] Inventor: Neil G. Richardson, Montreal, Canada

[73] Assignee: Domtar Inc., Montreal, Canada

[21] Appl. No.: 102,374

[22] Filed: Dec. 11, 1979

[51] Int. Cl.[1] ..... B05D 3/00; B05D 3/12; B05D 1/18

[52] U.S. Cl. ..... 427/352; 427/297; 427/370; 427/440

[58] Field of Search ..... 427/297, 351, 352, 440, 427/370

[56] References Cited

U.S. PATENT DOCUMENTS

| | | | |
|---|---|---|---|
| 675,826 | 6/1901 | Geisler | 427/297 X |
| 2,838,424 | 6/1958 | DePew et al. | 427/297 |

*Primary Examiner*—Michael R. Lusignan

[57] ABSTRACT

The surface of an impregnated wood material having deposits of a water-insoluble treating chemical thereon as a result of the impregnation treatment, is cleaned by forming an ammoniacal liquor in situ on the surface of the wood material, dissolving the surface deposit in the ammoniacal liquor and permitting the dissolved treating chemical to migrate into the wood.

6 Claims, No Drawings

WOOD TREATMENT PROCESS

FIELD OF THE INVENTION

The present invention relates to a method of producing a clean surface on a wood material impregnated with a water insoluble treating chemical in an ammoniacal solvent.

DESCRIPTION OF THE PRIOR ART

In the process of treating wood by impregnation with an ammoniacal solution of water-insoluble treating chemicals such as copper arsenate and the like, the surface of the impregnated wood is sometimes marred by unsightly stains and blotches which detract from the appearance of the product. These stains and blotches are produced by deposition of treating chemical onto the surface of the wood and thus also result in the waste of chemical since such chemical on the surface does little if anything to protect the wood material itself.

It has been proposed to prevent the formation of such stains or blotches on the surface of the treated wood material by subjecting the wood to an atmosphere of carbon dioxide immediately following the impregnation step. The carbon dioxide combines with the treating solution on the surface to form ammonium carbonate(s) which stabilizes and maintains the ammoniacal solution and thereby prevents the chemical within the treating solution from precipitating until the liquid on the surface of the wood has disappeared. This process provides a significant improvement in the cleanliness of the wood surface. However, when treating species that are sometimes difficult to impregnate and where kickback conditions in the wood are such that treating chemical continues to ooze from the wood for a considerable period of time after the impregnation treatment, the carbon dioxide technique is not effective to prevent precipitation of the chemical brought to the surface by the kickback phenomena.

It is thus the object of the present invention to provide a technique wherein wood materials impregnated with a water insoluble treating chemical in an aqueous ammoniacal solvent may be cleaned after substantially all surface deposits have been formed.

BRIEF DESCRIPTION OF THE INVENTION

Broadly, the present invention comprises a process for cleaning wood material which has been pressure impregnated with an aqueous ammoniacal liquor containing in solution a water-insoluble treating chemical, surfaces of the impregnated wood material being substantially free of pools of the liquor and having deposits of the treating chemical thereon, the process comprising the steps of forming an aqueous ammoniacal solution in situ on the surfaces, dissolving the deposits in the solution, maintaining the deposits dissolved in the solution until the surface is substantially free of the liquid.

A preferred embodiment comprises the formation of the aqueous ammoniacal solution by exposing deliquescent deposits of the treating chemical on the surface to a moist ammoniacal atmosphere.

PREFERRED EMBODIMENT OF THE INVENTION

The present invention will generally be practised in the treating plant as part of the treatment process or shortly after the wood material has been impregnated with the ammoniacal solution.

Conventional impregnation of the wood material using an ammoniacal solvent for a water insoluble treating chemical comprises placing the wood material in a pressure vessel, filling the vessel with the treating solution, in some cases the wood material is first subjected to a vacuum before immersion in the treating solution, applying pressure to the charged vessel thereby to impregnate the immersed wood material with a requisite amount of chemical. This impregnation is generally carried out at a temperature above the ambient e.g. about 80°-150° F. while the pressure is generally between 100-200 psi depending on the temperature of treatment, the species of wood being treated, etc. The impregnation is terminated when the requisite amount of treating liquor has been driven into the wood, a process which generally requires several hours.

Commonly used treating chemicals include copper or zinc arsenates or copper carbonate and the like in an aqueous ammoniacal solution. If desired, further additives such as suitable fire retardants and/or water proofing agents or the like can be used.

After the impregnation is terminated, the pressure is released and the liquor surrounding the now impregnated wood is withdrawn from the vessel and the wood is eventually discharged from the vessel and permitted either to air-dry.

Using this conventional process as above described, deposits are sometimes formed on the surface of the wood. These deposits detract from the appearance of the wood and in fact represent a loss of treating chemical.

It has been found that these deposits may be removed from the surface and incorporated into the wood by forming, in situ, an ammoniacal solution on the surface of the wood, to dissolve the surface deposits of the treating chemical and maintaining the deposits dissolved in the solution until the surface is free of the liquid.

It is preferable that the wood material has been sufficiently dried by air drying, kiln drying or by some other means such that there is enough void space immediately adjacent the surface to absorb a significant portion of the aqueous ammoniacal solution that is formed on the surface in the following treatment step. This treatment step will preferably be carried out following at least about 2 or 3 days of air drying following the impregnation of the wood.

The ammoniacal solution can be provided on the surface in a variety of ways depending on the treating chemical deposited. For example, if a treating chemical which exhibits deliquescence in a moist ammoniacal atmosphere, (such as copper arsenate) constitutes the deposit, the formation of the solution can be carried out merely by placing the wood in an atmosphere rich in ammonia and water vapour. The deliquescing treating chemical absorbs the moisture and ammonia, forming the ammoniacal solution which dissolves it; these steps taking place with near simultaneity. The moist ammoniacal atmosphere can be the result of sparging an ammoniacal solution with air and passing the moist ammonia-bearing air through the vessel containing the wood. Such a process can conveniently be operated in a cyclic manner with the moist ammonia bearing air being admitted in one port and withdrawn via another, where some of the air admitted has been freshly sparged through a solution of aqueous ammonia, thereby replenishing the moisture and the ammonia content which may have diminished in the previous pass through the wood-containing vessel. Alternatively, atomized aqueous ammonium hydroxide may be added to the circulating air, in order to provide the moist ammoniacal environment surrounding the wood. This may alternatively be carried out by placing a sufficient amount of a concentrated aqueous ammoniacal solution in the bottom of the vessel containing the wood so as to surround the wood with a moist ammoniacal atmosphere thereby forming the solution on the surface of the wood. The exposure of deliquescent chemicals, such as those noted above, to moisture and ammonia results in the dissolution of the deposits in the aqueous ammoniacal solution formed in situ. A particularly attractive feature of this procedure is that it provides the ammoniacal solution exactly where it is needed to dissolve the deposited chemicals.

Other means of obtaining a moist ammoniacal atmosphere can equivalently be employed, for example partially dried impregnated wood material which has retained some of the moisture and ammonia from the impregnating solution can be placed in an enclosed space causing equilibration of the moisture and ammonia content of the wood with its environment. If the moisture and ammonia content of the wood is high enough, it will provide an atmosphere rich enough in ammonia to solubilize the deposited chemical. The formation of the ammoniacal atmosphere in such an operation can be enhanced by the use of a higher ammoniacal concentration in the impregnating solution.

The ammoniacal solution can alternatively be provided by wetting the surface with water and then exposing it to ammonia gas. While this technique is effective for both deliquescent and nondeliquescent treating chemicals, it has the drawback in the case of dry wood that the water applied must not be absorbed too rapidly into the wood otherwise it will not be in contact with the deposit long enough to form a solution.

The aqueous ammoniacal solution which incorporates the deposits on the surface therein is believed to be absorbed into the wood, or leave the surface by some equivalent mechanism. In order to prevent redeposition of the treating chemical it is essential that the deposits be maintained in solution until the surface is substantially free of liquid pools. Due to the volatile nature of the ammoniacal component of the solution, it is desirable that the solution be maintained in an atmosphere having a suitable concentration of gaseous ammonia, in order that the equilibrium ammonia concentration in the solution is kept at a level high enough to maintain the deposit in solution during its incorporation into the wood.

The dissolved deposits will typically take a period of at least 4 hours to be removed from the surface, however the time period most appropriate for a given operation will be best determined by observation of the wood surface after various treatment times. It has been observed, in the case of deliquescent surface deposits, that all other treatment conditions being unaltered, the drier the wood material, the longer will be the period required to remove the surface deposits. This can possibly be explained by absorption of the moisture initially by the drier wood in preference to the dissolution of the deliquescent deposit, followed by the formation of the ammoniacal solution which dissolves the deposits.

It is not necessary that this treatment be carried out in the same vessel as the impregnation. A separate vessel which is capable of accommodating the wood material and which does not permit losses of significant quantities of water vapour and ammonia therefrom, may be used. In fact, the use of a vessel or cylinder is not mandatory. Any enclosed space which is capable of retaining an adequate concentration of moisture and ammonia in the environment surrounding the wood material, for a time period sufficient for the wood surface to be free of the dissolved deposits, can be used for this treatment.

Following the treatment, it is preferable that the wood material be removed to a quiescent atmosphere and the surface permitted to dry gradually. Exposure to high winds or rain or rapid heating in a kiln could cause some reprecipitation of the treating chemical on the surface.

In any event, it has been found that by dissolving the chemical forming the surface deposits in the ammoniacal liquor formed in situ and permitting the deposit dissolved in this liquor to disappear into the wood a resultant product having a "clean" surface is obtained.

The term "clean" as used herein will have clear and unambiguous meaning to the man skilled in the art in the sense that it will be generally easily assessed by visual inspection. Such visual inspection of course is a subjective test but there is a clear line of demarkation between a "dirty" surface and a "clean" surface as produced by the present invention.

The following examples will serve to further illustrate the process of present invention.

EXAMPLE 1.

Western hemlock samples, 20"×2"×4" in dimension, were pressure impregnated with an aqueous ammoniacal liquor containing a 3% by weight of copper arsenate and about 2.7% by weight of dissolved ammonia (normally known as the "Chemonite" (TM) solution) and kiln dried to a moisture content of approximately 19% (bone-dry basis). The samples had dirty surfaces formed by the precipitation of copper arsenate on the surface. 4 of the samples were immersed in water for 10 minutes to increase the moisture content at the surface of the wood and were placed in a 30"×12"×12" enclosure containing 10"×6"×2" dish containing 1 liter of 10% aqueous ammonium hydroxide solution. 2 of the samples were withdrawn from this ammoniacal atmosphere after 3 hours, while the remaining samples which were initially considered dirtier were withdrawn after 5 hours, and in both cases the surfaces were found to be clean.

EXAMPLE 2.

Two batches of "Chemonite" (TM)-impregnated 2"×6"×8' samples of hemlock lumber having been air-seasoned for two days and two weeks respectively, were charged to a cylinder. An ammoniacal solution composed of two parts (by volume) of Chemonite (TM) and one part of concentrated ammonium hydroxide solution (29% ammonia content) was added to the bottom of the cylinder and the cylinder closed to permit its interior to equilibrate with the ammoniacal solution. Samples from each of the batches were removed from the cylinder after residence periods of 2, 4, 8 and 17 hours at ambient temperature (about 25° C.) and pressure.

The surface of the wood samples was examined a day after they were withdrawn and the observations are summarized in Table I below. The results suggest that wood material which has been air seasoned for longer periods of time, i.e. more depleted of its moisture content initially demonstrates a greater affinity for water than does the deliquescent deposit; however, once equilibrium is established between the wood and the environment, the deliquescent deposit dissolves by forming an ammoniacal solution in situ, and leaves the wood surface.

TABLE I

| Air Seasoning Time | Residence time in cylinder (hrs.) 2 | 4 | 8 | 17 |
|---|---|---|---|---|
| 2 days | about 50% clean | clean | clean | clean |
| 2 weeks | dirty | improvement over 2 hrs. | about 50% clean | clean |

EXAMPLE 3.

"Chemonite" (TM)-impregnated samples (3"×2"×¾") of red pine were coated with copper arsenate suspension produced by sparging air through a 10% "Chemonite" (TM) solution and then dried so as to produce uniform deposits on the surface thereof. Following this treatment, some of the samples were conditioned to moisture contents of 10 and 25%, while others were rewetted and conditioned to a 35% moisture content.

The samples were placed in a cylinder of length 4.5 ft. and 8 inches diameter having inflow and outflow ports at the opposite ends. Air sparged through an aqueous solution of ammonium hydroxide was passed through the cylinder. This was repeated for ammoniacal solutions having concentrations of 3 and 10%, while the temperature of the sparging air was 20° and 40° C. in the different sets of runs.

The experimental conditions and results are summarized in Table 2 below, where the entries in the column "% of surface cleaned" represent a visual estimate of the proportion of the deposit removed from the surface.

The results, in addition to supporting the conclusion regarding the relation between the moisture content of the wood material and the time required for cleaning it arrived at in the previous example, indicate the important role played in the process by the temperature of the solution being sparged and thus, the effects of the concentration of the ammonia and water in the atmosphere surrounding the wood.

TABLE 2

| Flow rate of air through cylinder (l/min.) | Ammonium hydroxide solution temp. (°C.) | Ammonium hydroxide solution concn. (%) | Wood Moisture Content (%) | Time of test (hr.) | % of surface cleaned |
|---|---|---|---|---|---|
| 0.5 for 15 min., then 0.1 | 20 | 10 | 35 | 2 | 100 |
| | 20 | 10 | 25 | 4 | 100 |
| | 20 | 10 | 10 | 7 | 10 |
| 0.5 for 15 min., then 0.1 | 20 | 3 | 35 | 7 | 50 |
| | 20 | 3 | 25 | 7 | 40 |
| | 20 | 3 | 10 | 7 | 0 |
| 1.0 for 15 min., then 0.5 | 40 | 10 | 25 | 2.5 | 100 |
| | 40 | 10 | 10 | 5 | 75 |
| 0.5 for 15 min., then 0.1 | 40 | 3 | 35 | 3 | 100 |
| | 40 | 3 | 25 | 6 | 75 |
| | 40 | 3 | 10 | 6 | 0 |

EXAMPLE 4.

In a static analogue of the preceding experiment, wood samples prepared in a fashion similar to the above and having varying moisture contents were suspended in the air space above a 10% ammonium hydroxide solution at 20° C., in closed beakers. The change in the surface quality was noted following a period of observation. This procedure was repeated for a solution having a 3% concentration.

The results summarized in Table 3 below indicate the effect that ammonia concentration in the air space and the moisture content of the wood, have in improving the surface quality of the wood.

TABLE 3

| Ammonium Hydroxide Solution Temp. (°C.) | Concentration (%) | Wood Moisture Content (%) | Time of Test (hr.) | % of Surface Cleaned |
|---|---|---|---|---|
| 20 | 10 | 40 | 1 | 100 |
| 20 | 10 | 25 | 4 | 100 |
| 20 | 10 | 10 | 7 | 80 |
| 20 | 3 | 25 | 5 | 75 |
| 20 | 3 | 10 | 5 | 0 |

Modifications may be made without departing from the spirit of the invention as defined in the appended claims.

The embodiments of the present invention in which an exclusive property or privilege is claimed are as follows:

1. A process for cleaning wood material which has been pressure-impregnated with an aqueous ammoniacal liquor containing in solution, a water-insoluble treating chemical, surfaces of said impregnated wood material being substantially free of pools of said liquor and having deposits of said treating chemical thereon, said process comprising the steps of forming an aqueous ammoniacal solution in situ on said surfaces, dissolving said deposits in said solution, maintaining said deposits dissolved in said solution until said surface is substantially free of liquid.

2. A process for the treatment of wood material comprising pressure impregnating a charge of wood material with an aqueous ammoniacal solution containing a water insoluble treating chemical, separating said impregnated material from excess of said solution, at least partially drying said wood material thereby substantially eliminating pools of liquid from surface of said wood material and producing deposits of said treating chemical on said surface, forming an aqueous ammoniacal solution in situ on said surface, dissolving said deposits in said solution, maintaining said deposits dissolved in said solution until said surface is substantially free of said deposits.

3. A process as defined in claims 1 or 2 wherein said treating chemical contains a member of the group comprising copper, zinc and arsenic.

4. A process as defined in claim 3 wherein said aqueous ammoniacal solution is formed by exposing said wood material to a moist ammoniacal atmosphere.

5. A process as defined in claims 1, 2 or 3 wherein said aqueous ammoniacal solution is formed by wetting surface of said wood material and exposing said surface to ammonia gas.

6. A process as defined in claim 3 wherein a portion of the moisture and ammonia components of said aqueous ammoniacal solution are provided by said impregnated wood material.

* * * * *